United States Patent [19]

Sanderson

[11] 3,945,769

[45] Mar. 23, 1976

[54] SELF-OSCILLATING FAN

[76] Inventor: Jeffrey P. Sanderson, P.O. Box 233, Rochelle, Ill. 61068

[22] Filed: Feb. 11, 1974

[21] Appl. No.: 440,955

[52] U.S. Cl. ..... 417/361; 417/423 R; 416/79; 74/5 R; 74/5.22

[51] Int. Cl.[2] ..... F04B 9/02

[58] Field of Search ..... 417/361, 363, 423; 416/79–81; 74/5, 5.22, 5.7, 5.8

[56] References Cited

UNITED STATES PATENTS

| | | | |
|---|---|---|---|
| 755,199 | 3/1904 | Wellman | 416/79 |
| 1,328,255 | 1/1920 | Anderson | 416/79 |
| 1,647,148 | 11/1927 | Roserman | 74/5.7 |
| 1,802,108 | 4/1931 | Chessin | 74/5.7 |
| 2,650,019 | 8/1953 | Lautner et al. | 417/361 |
| 3,608,384 | 9/1971 | Hardin | 74/5.22 |
| 3,618,403 | 11/1971 | Bilinski | 74/55 |

*Primary Examiner*—C. J. Husar
*Attorney, Agent, or Firm*—John R. Diver

[57] ABSTRACT

A fan having a single degree of freedom to torsionally oscillate in a horizontal plane which in one version oscillates about a fixed vertical axis, self-excited by an aerodynamic couple created by feathering vertically disposed vanes which are symmetrically located adjacent the tips of the fan blades on the air inflow side thereof, and in another version which oscillates about a pendulous axis, self-excited by precession of the rotating fan and motor armature as a pendulous gyro.

2 Claims, 5 Drawing Figures

SELF-OSCILLATING FAN

BACKGROUND OF THE INVENTION

Mechanically driven oscillating fans are old in the art. These fans are complicated and suffer the economic disadvantage of high cost and weighty structure due to the mechanical devices required to convert fan motor drive rotation into fan oscillation. This is especially true of larger fans.

Aerodynamically excited oscillating fans have been proposed in the art but the two degree of freedom horizontal oscillating mechanisms used to obtain reversing aerodynamic turning moments on the fan disk are overly complex and not practical.

Gyroscopically excited oscillating fans have been proposed in the art but the precession of the fan is conical requiring complicated gymbal mounts and not limited to an oscillation in a horizontal plane.

There is thus an established need for a self-excited oscillating fan having horizontal oscillations induced by means without the aid of complex mechanical devices.

SUMMARY OF THE INVENTION

The gist of this invention lies in a motor and fan combination having its axis of rotation lying in a horizontal plane, which system is elastically constrained to angularly oscillate between limiting stops in the horizontal plane. One system is self-excited by a reversing aerodynamic couple which acts in a horizontal plane about the axis of oscillation of the motor and fan combination. Another system is self-excited by a gyroscopic couple which causes the rotating motor armature and fan disk to precess as a gyroscope.

The reversing aerodynamic couple has its origin in two feathering vanes which are pivotally mounted to oscillate about vertical axes and which are symmetrically spaced and laterally disposed on each side of the oscillation axis of the fan adjacent to the blade tips and on the air inflow side thereof. The vane feathering mechanism comprises a four-bar linkage having two short links of equal length each connected at one end to each of the axes of said vanes at the top ends thereof and each pivotally connected at the other ends thereof to a third long link connecting the other ends of the two short equal links therebetween so as to present at fan oscillation frequency in alternating reversing sequence a flat attitude by one vane relative to the air inflow to the fan on one side of the oscillation axis and an edge-on attitude relative thereto on the other side thereof.

DESCRIPTION OF THE PREFERRED EMBODIMENT

Figure 1:
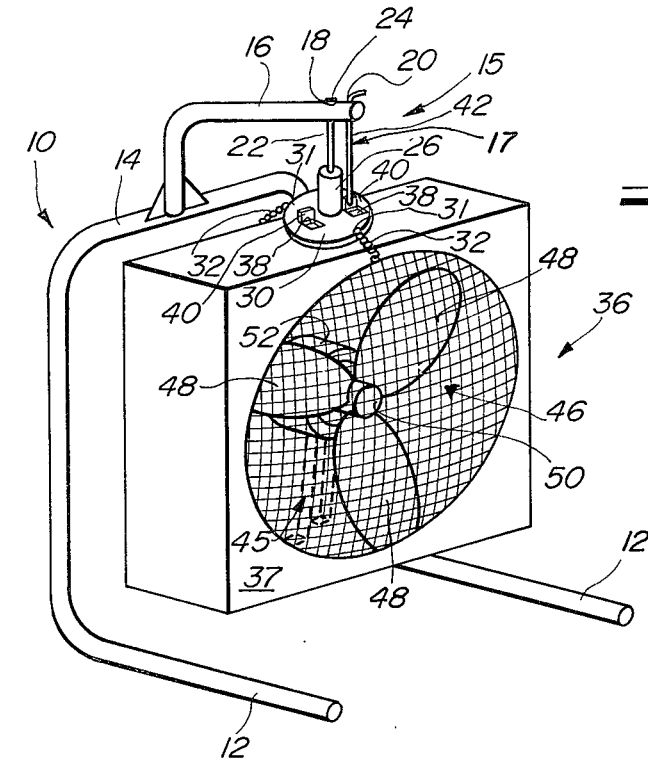
FIG. 1 is a perspective view of a floor-mounted, self-oscillating fan according to the teachings of this invention.

Reference to FIG. 1 shows a floor-mounted, self-oscillating fan comprising a stand 10 having two opposed legs 12, a cross-bar 14 tying the opposed support legs 12 together, an arm 16 mounted on cross-bar 14 midway between support legs 12 and extending forward in the same direction thereof. A fan pendulous suspension means 15 comprises a first aperture 18 in and adjacent to the forward end of the arm 16 and vertically disposed therethrough and midway between opposed sides thereof, a second aperture 20 in the arm 16 between said first aperture 18 and the forward end of the arm 16 also vertically disposed therethrough and midway between opposed sides thereof, a nylon cord 22 having one end threaded through the first aperture 18 and the other end extending downward in a vertical direction, a a knot 24 secured in the one end of the cord 22 above said arm 16 for preventing the passage of the cord 22 downward through the aperture 18, a sleeve member 26 having its hollow center disposed in a vertical direction and central therein and the lower end of said cord 22 threaded therethrough, a knot 28 (not shown) secured in said lower end of the cord below said sleeve 26 for preventing the passage of the cord 22 upward through the hollow of the sleeve 26, a circular plate member 30 having its top surface secured to the lower end of said sleeve 26 and concentrically located thereon, opposed third apertures 31 disposed in the sleeve 26 and bored in the plate 30 in the same forward and aftward directions relative to the sleeve 26 and adjacent to the circumference thereof, opposed chains 32 secured at top ends thereof to the third apertures in plate 30 and downwardly hanging and outwardly extending therefrom, and hooked ends 34 which are at the ends of each of the opposed chains 32 disposed in the forward and aftward directions relative to the sleeve 26 and its plate 30. A conventional floor-mounted fan 36 having a housing 37 is hooked to and supported on a vertical line extending downward through the hollow of sleeve 26 and roughly passing through the fan, motor and housing 36 center of gravity by the downwardly hanging hooked ends 34 of the chains 32.

A fan suspension-restoring torque means 17 having a restoring torque characteristic with a non-linear functional relation with fan oscillation angle comprises slots 38 which are in concentric relation with the hollow center of the sleeve 26 and are cut through the surfaces of plate 30 at equal distances from the hollow center of sleeve 26 on the laterally opposed sides of the arm 16. Circumferential stops 40 are adjustably positioned in slots 38 and secured to the top surface of the plate 30 by conventional nut and throughbolt combination. Cantilevered spring bar 42 has a hooked top end which passes through and is clamp-end supported in the second aperture 20 in the forward end of the arm 16. The lower extremity of cantilever spring bar 42 extends downward from arm 16 in parallel relation with supporting nylon cord 22 and ends just short of the top surface of the plate 30 so that as circumferential plate 30 oscillates about nylon cord 22 as the center of oscillation of the fan 36, the lower end of spring bar 42 engages first and second circumferentially spaced lugs 40, mounted at equal radial distance from the oscillation axis thereof on the top surface of plate 30, in alternate reciprocal succession as the lugs 40 limit the fan 36 in oscillation amplitude thereon.

A motor-fan combination 45 is comprised of a fan disk 44 having a plurality of fan blades 48 mounted on rotating shaft 50 centrally disposed therein and having an electric motor 52 coupled thereto for driving the fan disk 46. Fan housing 37 solidly mounts the housing of fan motor 52.

In the operation of the pendulously-suspended, gyroscopically actuated, self-oscillating fan having a non-linear fan suspension-restoring torque means 17, as shown in FIG. 1, the restoring torque on the fan is non-linear with oscillation angle. Oscillation of the system occurs principally in a horizontal plane with the nylon cord 22 as the torsion center and is limited in amplitude thereabout by adjustable circumferential lugs 40 which contact cantilevered spring bar 42 near the peak oscillation amplitude point of each half-cycle oscillation. Larger oscillation amplitudes of the fan are obtainable by adjustably moving the stops 40 circumferentially in the slots 38 in a direction away from the front of fan 36 and clamping the lugs 40 in slots 38.

Figure 2:
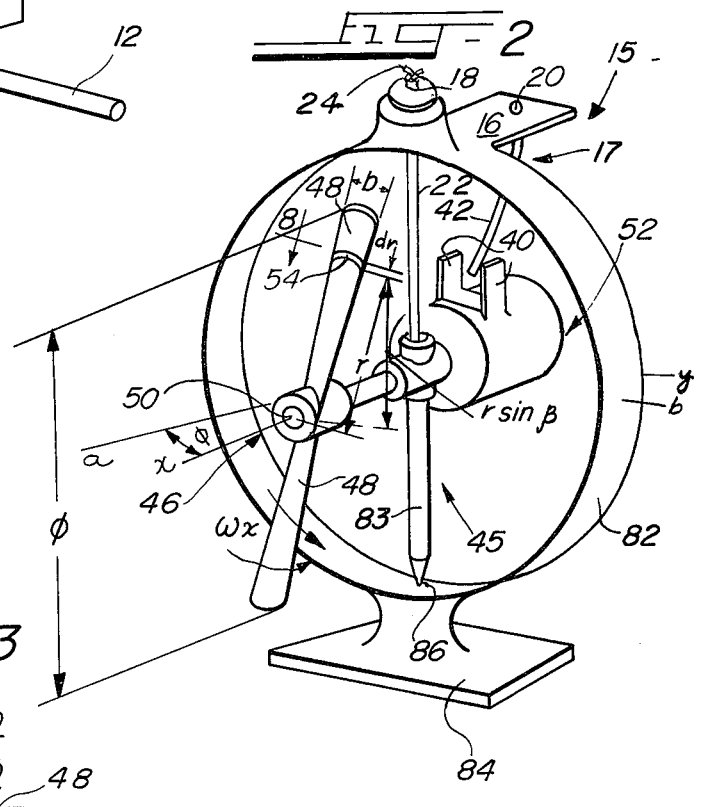
FIG. 2 is a perspective schematic view of the basic elements of the fan of FIG. 1 having gyroscopic excitation.
Figure 3:
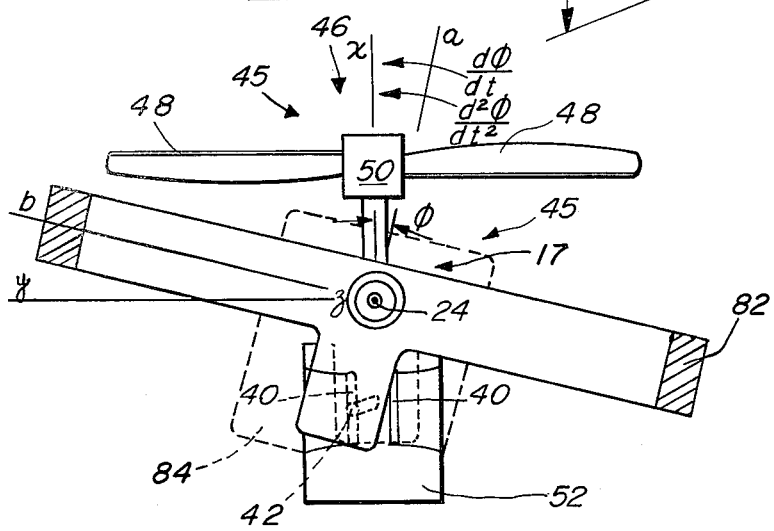
FIG. 3 is a top view of the schematic fan of FIG. 2.

Reference to FIGS. 2 and 3 shows principal elements of the pendulously suspended, gyroscopically excited, self-oscillating fan comprising a motor-fan combination 45 suspended on an annular ring 82 mounted on a base 84. A nylon cord 22 suspends the motor-fan combination 45 at its center of gravity from the top of the ring 82 by threading said cord through an aperture in the ring 82 and tying a knot 24 therein on the top side thereof. An indexing pointer 83 is suspended above the inside of the bottom portion of the ring 82 directly below the suspension point at the top of ring 82. A spring bar 42 is structurally mounted to the inside of a rearward extension of the top of the ring 82 and extends downwardly therefrom. Spaced lugs 40 straddle-mounted to each side of the lower end of bar 42 engage the same when the motor-fan 45 nears its peak oscillator amplitude to each side of center.

Figure 4:
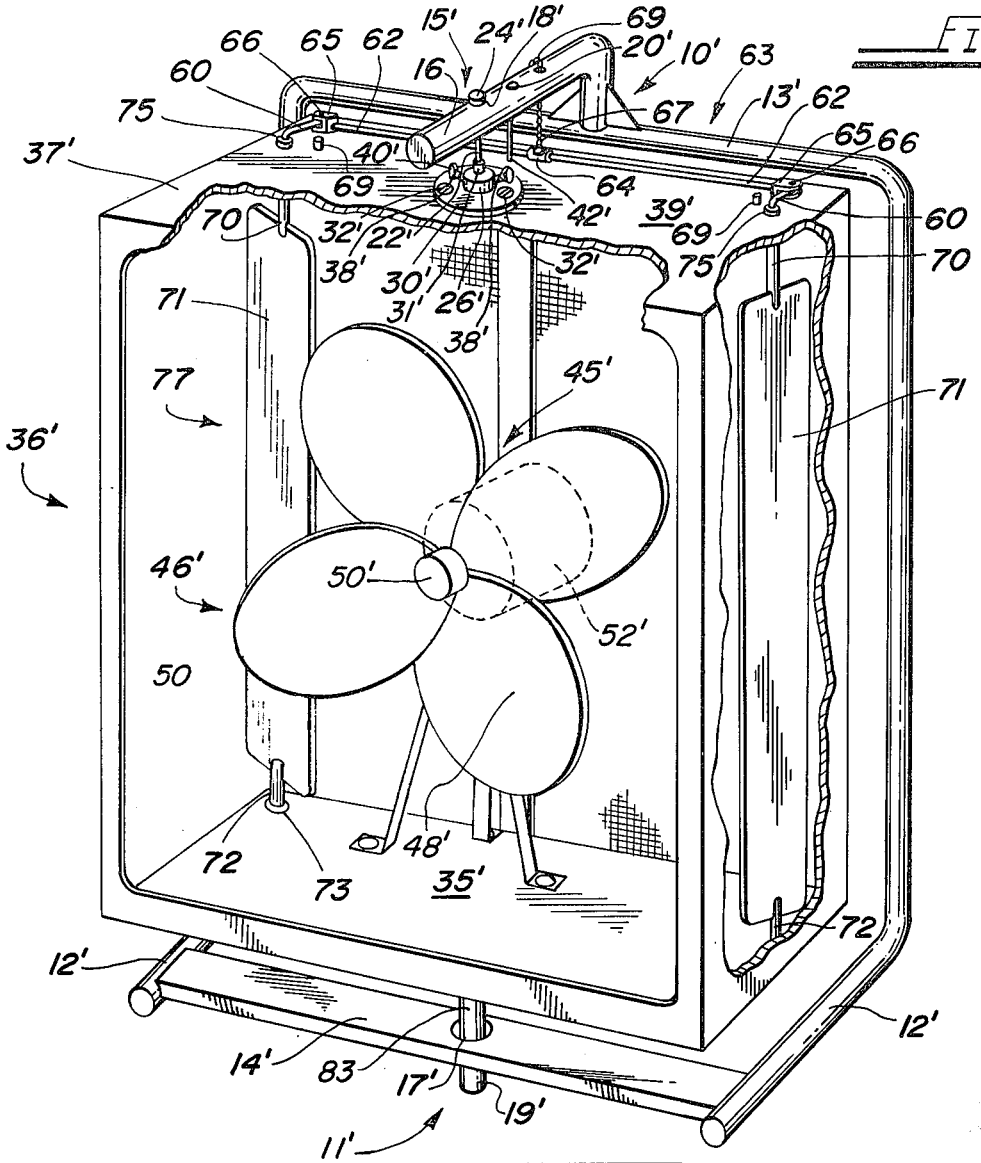
FIG. 4 is a perspective cutaway view of the basic elements of the fan of FIG. 1 having aerodynamic excitation.

Reference to FIG. 4 shows a floor-mounted, self-oscillating, aerodynamically excited fan comprising a stand 10′ having two opposed legs 12′, upper and lower cross-bars 13′ and 14′ tying the opposed support legs 12′ together, an arm 16′ mounted on cross-bar 14′ midway between support legs 12′ and extending forward in the same direction thereof. A fan pendulous suspension means 15′ comprises a first aperture 18′ in and adjacent to the forward end of the arm 16′ and vertically disposed therethrough and midway between opposed sides thereof, a second aperture 20′ in the arm 16′ between said first aperture 18′ and the forward end of the arm 16′ also vertically disposed therethrough and midway between opposed sides thereof, a nylon cord 22′ having one end threaded through the first aperture 18′ and the other end extending downward in a vertical direction, a knot 24′ secured in the one end of the cord 22′ above said arm 16′ for preventing the passage of the cord 22′ downward through the aperture 18′, a sleeve member 26′ having its hollow center disposed in a vertical direction and central therein and the lower end of said cord 22′ threaded therethrough, a knot 28′ (not shown) secured in said lower end of the cord below said sleeve 26′ for preventing the passage of the cord 22′ upward through the hollow of the sleeve 26′, a circular plate member 30′ having its top surface secured to the lower end of said sleeve 26′ and concentrically located thereon, opposed third apertures 31 disposed in the sleeve 26 and bored in the plate 30 in the same forward and aftward directions relative to the sleeve 26′ and adjacent to the circumference thereof, screws 32′ secured at top ends thereof to the third apertures in plate 30′ and downwardly hanging and outwardly-extending therefrom. A conventional floor-mounted fan 36 having a housing 37 is screwed to and supported on a vertical line extending downward through the hollow of sleeve 26′ on a line roughly passing through the fan, motor and housing 36 center of gravity.

A fan suspension-restoring torque means 15′ having a restoring torque characteristic with a non-linear functional relation with fan oscillation angle comprises circumferentially spaced first and second wing-bolts 38′ which have their head-ends 40′ in concentric relation with and spaced from the hollow center of the sleeve 26′ and are radially threaded into the sleeve 26′ on the laterally opposed sides of the arm 16′. Cantilevered spring bar 42′ has a hooked top end which passes through and is clamp-end supported in the second aperture 20′ in the forward end of the arm 16′. The lower extremity of cantilever spring bar 42′ extends downward from arm 16′ in parallel relation with supporting nylon cord 22′ and ends just short of the top surface of the plate 30′ so that as circumferential plate 30′ oscillates about nylon cord 22′ as the center of oscillation of the fan 36′, the lower end of spring bar 42′ engages first and second head-ends 40′ in alternate reciprocal succession to limit the fan 36′ in oscillation amplitude thereon.

A motor-fan combination 45′ is comprised of a fan disk 46′ having a plurality of fan blades 48′ mounted on rotating shaft 50′ centrally disposed therein and having an electric motor 52′ coupled thereto for driving the fan disk 46′. Fan housing 37′ solidly mounts the housing of fan motor 52′.

A fan stabilizer 11′ comprises a clearance aperture 17′ which extends through the cross-bar 14′ of the stand 10′ in a direction perpendicular to the horizontal and is located on the axis of oscillation of the fan. Rod 18′ is mounted to the bottom 35′ of the housing 37′ on the axis of oscillation thereof and loosely engages aperture 17′ in extension therethrough.

Figure 5:
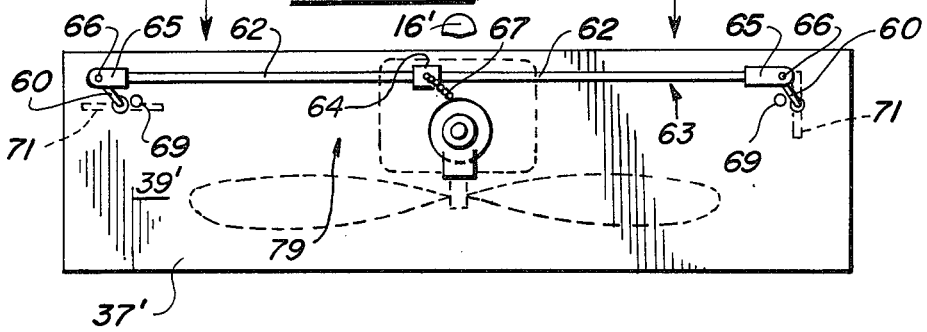
FIG. 5 is a top view of the fan of FIG. 4.

An aerodynamic exciter 77 comprises vanes 71 which are vertically disposed about an aerodynamic axis coincident with the oscillation axis and pivotally mounted in the top 39′ and bottom 35′ of the housing 37′ spaced equidistant from and adjacent to the tips of the fan blades 48′. Lower pivot ends 72 of vanes 71 mount in bearings 73 in the bottom 35′ of the housing 37′, and top pivot ends 70 thereof mount in bearings 75 and extend up therethrough. A vane feathering mechanism 79 comprises a four-bar linkage 63 which has short links 60 having equal lengths mounting on the pivot ends 70 of the vanes 71 above the top 89′ and extending in a generally outward and rearward direction in parallel relation with each other, as shown in FIG. 5. Stops 69 are mounted in top 39′ of the housing 10′ adjacent to pivot ends 70 for engaging the links 60 and limiting the oscillation amplitude of the vanes 71. Clevises 65 are mounted on the ends of a long link 62 each of which pivotally engages the outer ends of a respective link 60. A clamp 64 mounts on link 62 midway between the clevises 65 along the length thereof. An actuating chain 67 connects at one end to the clamp 64 and at the other end is threaded through aperture 69 in the arm 16 above and knotted thereon.

It is to be understood that numerous details of the construction shown may be altered or omitted without departing from the spirit of the invention as defined by the following claims.

I claim:

1. A self-exciting oscillating fan comprising:

a. a stand;

b. a torsionally elastic means suspended from the stand and having its elastic axis lying on the vertical;

c. a first polar moment of inertia means including a fan housing and a motor fixedly mounted therein and having an armature connected to said fan, the housing being suspended from the said torsionally elastic means and having an axis of polar moment of inertia coincident with the axis of said torsionally elastic means;

d. a second polar moment of inertia means comprising said fan, the motor armature and a shaft extending therebetween, said second moment of inertia means having its axis of polar moment of inertia lying in a horizontal plane and intersecting the polar axis of said first polar moment of inertia coincident with the axis of rotation of said fan, motor armature and shaft; and e. an aerodynamic means for self-exciting said first polar moment of inertia means in oscillation in a horizontal plane about said vertical elastic axis;

f. said aerodynamic means comprising feathering vanes pivotally mounted in said housing for rotation about axes substantially parallel to the axis of said torsionally elastic means and extending along each side of the fan adjacent the tips of the blades thereof; and g. means for feathering said vanes.

2. An aerodynamically self-excited oscillating fan as set forth in claim 1 wherein the vane feathering means comprises:

a. a four-bar linkage having two links of substantially equal length each fixedly connected at one end to the top end of a respective one of said vanes and each having its other end pivotally connected to a third link extending therebetween; and b. an actuating chain connected at one end to the third link and at the other end to the stand for operating said third link to shift the angular relation of said vanes relative to the fan disk.

* * * * *